US007218087B2

(12) United States Patent
Lin

(10) Patent No.: US 7,218,087 B2
(45) Date of Patent: May 15, 2007

(54) LOW-DROPOUT VOLTAGE REGULATOR

(75) Inventor: Chung-Wei Lin, Sinyuan Township, Pingtung County (TW)

(73) Assignee: Industrial Technology Research Institute, Hsinchu (TW)

( * ) Notice: Subject to any disclaimer, the term of this patent is extended or adjusted under 35 U.S.C. 154(b) by 0 days.

(21) Appl. No.: 11/326,049

(22) Filed: Jan. 4, 2006

(65) Prior Publication Data

US 2007/0057660 A1 Mar. 15, 2007

(30) Foreign Application Priority Data

Sep. 13, 2005 (TW) ..... 94131436 A

(51) Int. Cl.
*G05F 3/16* (2006.01)

(52) U.S. Cl. ..... 323/315; 323/280

(58) Field of Classification Search ..... 323/313, 323/314, 315, 316, 273, 274, 277, 280; 327/539, 327/540

See application file for complete search history.

(56) References Cited

U.S. PATENT DOCUMENTS

| | | | | |
|---|---|---|---|---|
| 5,625,278 | A | 4/1997 | Thiel et al. | 323/280 |
| 5,929,617 | A | 7/1999 | Brokaw | 323/280 |
| 6,188,211 | B1 * | 2/2001 | Rincon-Mora et al. | 323/280 |
| 6,225,857 | B1 | 5/2001 | Brokaw | 327/540 |
| 6,518,737 | B1 | 2/2003 | Stanescu et al. | 323/280 |
| 6,573,694 | B2 * | 6/2003 | Pulkin et al. | 323/273 |
| 6,690,147 | B2 | 2/2004 | Bonto | 323/280 |

OTHER PUBLICATIONS

Chaitanya K. Chava et al., "A Frequency Compensation Scheme for LDO Voltage Regulators" IEEE Transactions on Circuits and Systems—I: Regular Papers, vol. 51, No. 6, Jun. 2004, pp. 1041-1050.

Gabriel A. Rincon-Mora et al., "A Low-Voltage, Low Qulescent Current, Low Drop-Out Regulator" IEEE Journal of Solid-State Circuits, vol. 33, No. 1, Jan. 1998, pp. 36-44.

* cited by examiner

*Primary Examiner*—Jessica Han
(74) *Attorney, Agent, or Firm*—J.C. Patents

(57) ABSTRACT

The invention proposes a low dropout voltage regulator, including a feedback circuit, an operational amplifier, a transconductor, a current mirror, and a power transistor. The feedback circuit provides a voltage according to a current provided by the power transistor. An invert-phase input terminal of the operational amplifier is coupled with the feedback circuit, and the positive-phase input terminal of the operational amplifier receives a reference voltage. The transconductor is coupled to an output terminal of the operational amplifier, and controls the current, which is fed to the transconductor from the current mirror, according to the output voltage from the operational amplifier. The current mirror is coupled with the transconductor and drives the power transistor. The power transistor is coupled between the current mirror and the feedback circuit, so as to provide current to the feedback circuit.

12 Claims, 2 Drawing Sheets

LOW-DROPOUT VOLTAGE REGULATOR

CROSS-REFERENCE TO RELATED APPLICATION

This application claims the priority benefit of Taiwan application serial no. 94131436, filed on Sep. 13, 2005. All disclosure of the Taiwan application is incorporated herein by reference.

BACKGROUND OF THE INVENTION

1. Field of Invention

The present invention relates to a low dropout voltage regulator. More particularly, the present invention relates to a low dropout voltage regulator, suitable for use in a hand-held electronic apparatus.

2. Description of Related Art

The hand-held electronic apparatus has been in wide applications, and the battery duration is therefore requested to be longer and longer. If the power consumption due to quiescent current in the whole system can be reduced, the operation duration for the hand-held electronic apparatus in use can be prolonged. However, for the usual low dropout voltage regulator, the quiescent current does not vary with the loading current.

For example, FIG. 1 is a drawing, schematically illustrating the conventional low dropout voltage regulator 100. In FIG. 1, the low dropout voltage regulator 100 receives a reference voltage VREF, and provides an output voltage Vout. Since the current consumed by the buffer 101 is almost constant, the consumption due to the quiescent current is still greater than at a certain level even if the whole circuit is at a low loading condition, that is, the loading current on the resistor $R_L$ being small. This continuous power consumption would decrease the operation duration of the hand-held apparatus.

SUMMARY OF THE INVENTION

The invention provides a low dropout voltage regulator, capable of reducing the power consumption of the quiescent current under a low loading condition, so as to further prolong the operation duration of the hand-held electronic apparatus.

In accordance with the foregoing or other objectives, the invention proposes a low dropout voltage regulator, including a feedback circuit, an operational amplifier, a transconductor, a current mirror, and a power transistor. The feedback circuit provides a voltage according to a current provided by the power transistor. An invert-phase input terminal of the operational amplifier is coupled with the feedback circuit, and the positive-phase input terminal of the operational amplifier receives a reference voltage. The transconductor is coupled to an output terminal of the operational amplifier, and controls the current, which is fed to the transconductor from the current mirror, according to the output voltage from the operational amplifier. The current mirror is coupled with the transconductor and drives the power transistor. The power transistor is coupled between the current mirror and the feedback circuit, so as to provide current to the feedback circuit.

In the foregoing low dropout voltage regulator, for an embodiment, the quantity of the current fed to the transconductor from the current mirror is an increasing function of the output voltage from the operational amplifier.

In the foregoing low dropout voltage regulator, for an embodiment, the power transistor is a power MOSFET (metal oxide semiconductor field effect transistor).

In the foregoing low dropout voltage regulator, for an embodiment, the low dropout voltage regulator further includes a compensation capacitor and a compensation network. One coupling terminal of the compensation capacitor is coupled to the output terminal of the operational amplifier, while the other coupling terminal is grounded. The compensation network is coupled between the output terminal of the feedback circuit and the invert-phase input terminal of the operational amplifier. The compensation capacitor results in a pole point of a loop gain in the low dropout voltage regulator, and the compensation network results in a zero point of the loop gain. The pole point and the zero point affect the unit-gain frequency of the loop gain, so that the phase margin of the loop gain is greater than zero.

In the foregoing low dropout voltage regulator, for an embodiment, the compensation network is a voltage-to-current converter.

In accordance with the foregoing embodiments, since the low dropout voltage regulator of the invention has used the current mirror to serve as a buffer, the current of the current mirror becomes large when loading current becomes large, and the current of the current mirror becomes small when loading current becomes small. When the circuit is operated under a low loading condition, the power consumption of the quiescent current is accordingly reduced. In other words, the invention can reduce the quiescent power when it is under a low loading condition, so that the operation duration of the hand-held electronic apparatus can be prolonged.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DESCRIPTION OF THE PREFERRED EMBODIMENTS

Figure 1:
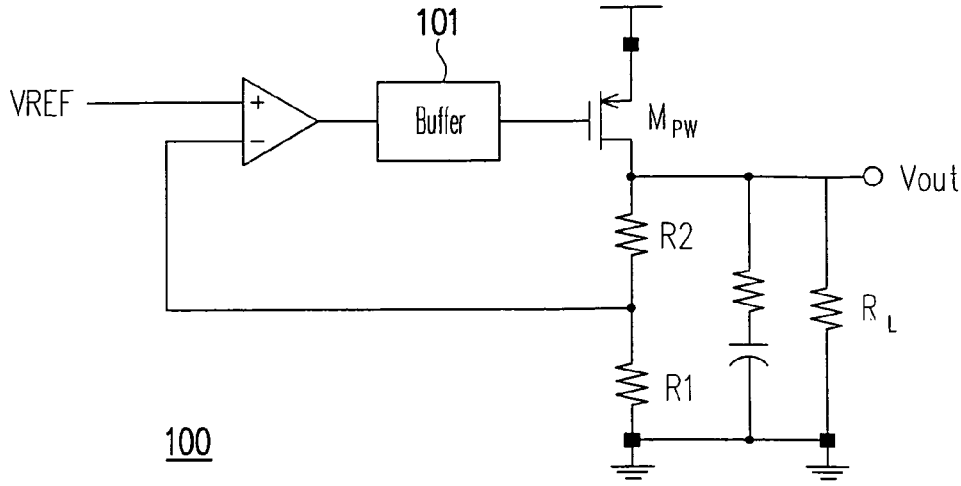
FIG. 1 (PRIOR ART)
FIG. 1 is a circuit diagram, schematically illustrating the conventional low dropout voltage regulator.
Figure 2:
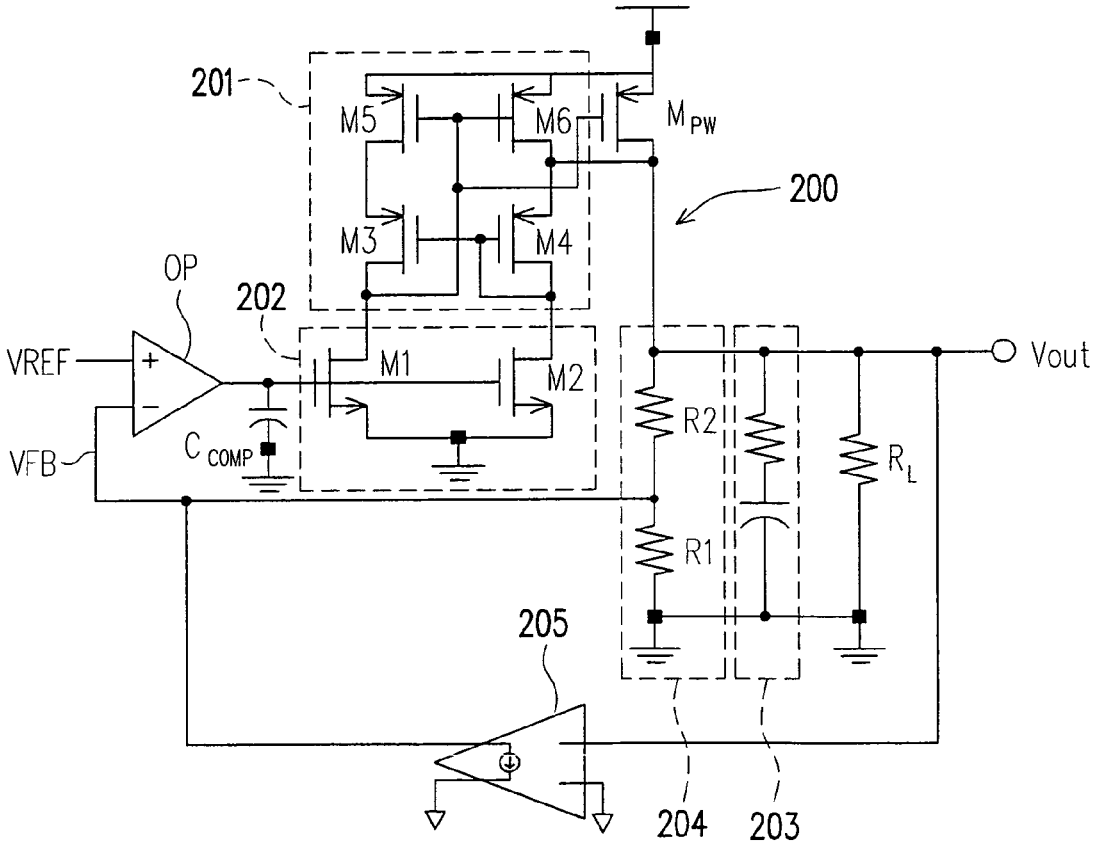
FIG. 2 is a circuit diagram, schematically illustrating a low dropout voltage regulator, according to an embodiment of the invention.

FIG. 2 is a circuit diagram, schematically illustrating a low dropout voltage regulator 200, according to an embodiment of the invention. The low dropout voltage regulator 200 can receive the reference voltage VREF, and provide a stable output voltage Vout. In the circuit of FIG. 2, the circuit other than the loading resistor $R_L$ is a part of the low dropout voltage regulator 200. More specifically, the low dropout voltage regulator 200 includes a feedback circuit 204, an operational amplifier (OP), a transconductor 202, a current mirror 201, a power transistor $M_{PW}$, a series circuit 203, a compensation capacitor $C_{COMP}$, and a compensation network 205. A main part of the low dropout voltage regulator 200 is formed from the feedback circuit 204, the operational amplifier (OP), the transconductor 202, the current mirror 201, and the power transistor $M_{PW}$, so as to form a feedback loop. The compensation capacitor $C_{COMP}$ and the compensation network 205 are used to improve the stability of the voltage regulator 200.

The feedback circuit 204 is coupled between the power transistor $M_{PW}$ and the operational amplifier OP, for providing an output voltage according to a current size fed from the power transistor $M_{PW}$, and providing a feedback voltage VFB to an invert-phase input terminal of the operational amplifier OP. In the embodiment, since the output voltage Vout is not equal to the reference voltage VREF, and the feedback voltage VFB is quite approaching to the reference voltage VREF, so that the feedback circuit 204 actually is a voltage divider, for receiving the output voltage Vout and sustaining a proportional relation between the output voltage Vout and the feedback voltage VFB. In order to have the voltage dividing function, the feedback circuit 204 is composed of resistors R1 and R2. A terminal of the resistor R1 is coupled to the feedback voltage VFB, which is the invert-phase input terminal of the operational amplifier OP. Another terminal of the resistor R1 is grounded. The resistor R2 is coupled between the output voltage Vout and the feedback voltage VFB. In FIG. 2, a proportional relation between the output voltage Vout and the feedback voltage VFB is Vout=(1+R2/R1)*VFB.

The invert-phase input terminal of the operational amplifier OP is coupled to the feedback terminal 204 and the positive-phase input terminal of the operational amplifier OP receives the reference voltage VREF. The transconductor 202 is coupled between the operational amplifier OP and the current mirror 201. The transconductor 202 is used for converting the voltage signal outputting from the operational amplifier OP into a current signal inputting to the feedback circuit 204. Actually, the transconductor 202 can control the current size, which is fed to the transconductor 202 from the current mirror 201, according to the output voltage of the operational amplifier OP. The transconductor 202 further controls the current size being fed to the feedback current 204 from the power transistor $M_{PW}$, and the current size being output to the load resistor R1 from the power transistor $M_{PW}$.

In the embodiment, the transconductor 202 includes N-type MOSFET's (NMOS transistors) M1 and M2. For the NMOS transistors M1 and M2, the drain electrodes are coupled to the current mirror 201, the gate electrodes are coupled to the output terminal of the operational amplifier OP, and the source electrodes are grounded. Therefore, the current being fed to the transconductor 202 from the current mirror 201 is an increase function of the output voltage of the operational amplifier OP.

The current mirror 201 is coupled between the transconductor 202 and the power transistor $M_{PW}$, for driving the power transistor $M_{PW}$. In the embodiment, the current mirror 201 is a wide-swing cascode current mirror. However, in the invention, any other current mirror, such as cascode current mirror, can be used.

The power transistor $M_{PW}$ is coupled between the current mirror 201 and the feedback circuit 204, for providing current to the feedback circuit 204 and loading resistor $R_L$. In the embodiment, the power transistor $M_{PW}$ can be power MOSFET. In FIG. 2, the source electrodes, the gate electrodes, and the drain electrodes of the power transistor $M_{PW}$ and the P-type MOSFET (PMOS transistor) M6 are respectively connected. As a result, the power transistor $M_{PW}$ and the PMOS transistor M6 can be considered as a single transistor. The power transistor $M_{PW}$ is larger, in size, than the PMOS transistor M6, and the resistance is relative small during conducting state. As a result, the power transistor $M_{PW}$ and the current mirror 201 together can serve as a current amplifier. After the current being fed to the NMOS transistor M1 from the current mirror 201 is amplified, the current is input to the feedback circuit 204 and the loading resistor $R_L$ from the power transistor $M_{PW}$.

The voltage regulating capability of the low dropout voltage regulator 200 is achieved by a feedback loop including the feedback circuit 204, the operational amplifier OP, the transconductor 202, the current mirror 201, and the power transistor $M_{PW}$. In order to reduce the quiescent current during the low loading condition, the invention uses the current mirror instead of the conventional buffer. In this manner, the current mirror causes an additional pole point in the signal path for the low dropout voltage regulator 200, and the pole point is varying with the loading current, which is the current flowing through the loading resistor $R_L$. In this situation, the compensation capacitor $C_{COMP}$ and the compensation network 205, associating with the series circuit 203, are used for compensation.

The series circuit 203 can be a simple circuit of a resistor and a capacitor coupled in series. One terminal of the series circuit 203 is coupled to the output voltage Vout, and the other terminal of the series circuit 203 is grounded, so that a dominant pole in the voltage regulator can be created. A terminal of the compensation capacitor $C_{COMP}$ is coupled to the output terminal of the operational amplifier OP, another terminal of the compensation capacitor $C_{COMP}$ is grounded. This adds one more pole point for the loop gain of the low dropout voltage regulator 200. This pole point is different from the pole point resulting from the series circuit 203 and the current mirror 201. The compensation network 205 is coupled between the output voltage Vout and the invert-phase input terminal of the operational amplifier OP, so that the foregoing loop gain add one zero point. In the embodiment, the compensation network 205 is a voltage-to-current converter. The pole point caused by the compensation capacitor $C_{COMP}$ and the zero point caused by the compensation network 205 affect the unit-gain frequency of the loop gain in the bode plot, so that the phase margin of the loop gain is greater than zero, and thereby the voltage regulator 200 is stable.

Figure 3:
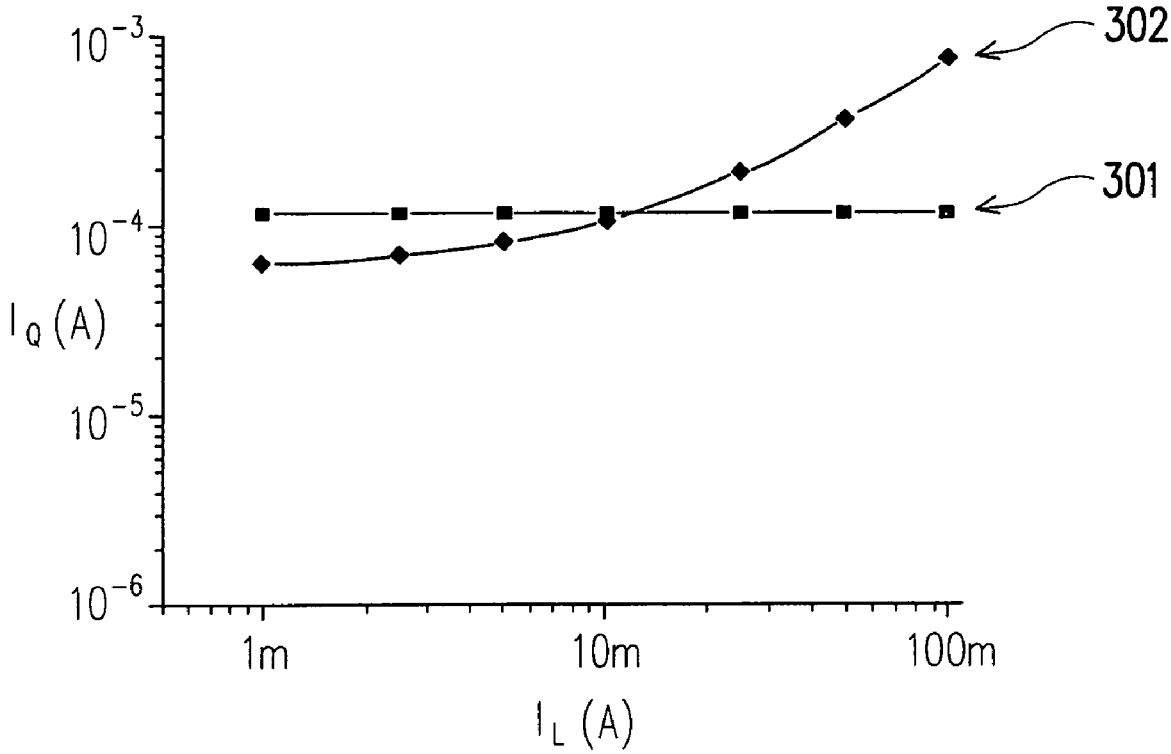
FIG. 3 is a drawing, schematically illustrating a comparison of the quiescent current and loading current between the conventional technology and the embodiment of the invention.

In the embodiment, the improvement about reducing the power consumption of the quiescent current is referred to FIG. 3. FIG. 3 is a drawing, schematically illustrating a comparison of the quiescent current $I_Q$ and the loading current $I_L$ between the conventional technology and the embodiment of the invention. The curve 301 represents the current for the prior art, and the curve 302 represents the current for the invention. In FIG. 3, in comparing the invention with the prior art, the quiescent current $I_Q$ at the low loading condition can be reduced by half.

In summary, since the low dropout voltage regulator of the invention has used the current mirror to serve as a buffer, the current of the current mirror becomes large when the loading current becomes large, and the current of the current mirror becomes small when the loading current becomes small. When the circuit is operated under a low loading condition, the power consumption of the quiescent current is accordingly reduced. In other words, the invention can reduce the quiescent power when it is under a low loading condition, so that the operation duration of the hand-held electronic apparatus can be prolonged.

It will be apparent to those skilled in the art that various modifications and variations can be made to the structure of the present invention without departing from the scope or spirit of the invention. In view of the foregoing descriptions, it is intended that the present invention covers modifications and variations of this invention if they fall within the scope of the following claims and their equivalents.

What is claimed is:

1. A low dropout voltage regulator, comprising:

a feedback circuit;

an operational amplifier, having an invert-phase input terminal coupled to the feedback circuit and a positive-phase input terminal receiving a reference voltage;

a transconductor, coupled to an output terminal of the operational amplifier;

a current mirror, coupled to the transconductor; and a power transistor, coupled between the current mirror and the feedback circuit, to provide a current to the feedback circuit, wherein the feedback circuit provides an output voltage according to the current from the power transistor, the transconductor controls a current inputting from the current mirror to the transconductor, according to the output voltage of the operational amplifier, and the current mirror drives the power transistor.

2. The low dropout voltage regulator of claim 1, wherein the feedback circuit further receives the output voltage and outputs a feedback voltage to the invert-phase input terminal of the operational amplifier, a constant proportional relation between the feedback voltage and the output voltage is set.

3. The low dropout voltage regulator of claim 2, wherein the feedback circuit comprises:

a first resistor having one terminal coupled to the feedback voltage, and another terminal being grounded; and a second resistor, coupled between the output voltage and the feedback voltage.

4. The low dropout voltage regulator of claim 1, wherein the current inputting from the current mirror to the transconductor is an increasing function of the output voltage of the operational amplifier.

5. The low dropout voltage regulator of claim 4, wherein the transconductor comprises:

a first MOSFET (metal oxide semiconductor field effect transistor); and a second MOSFET, wherein, in both the first MOSFET and the second MOSFET, drains electrodes are coupled to the current mirror, gate electrodes are coupled to the output terminal of the operational amplifier, and source electrodes are grounded.

6. The low dropout voltage regulator of claim 5, wherein the current inputting from the power transistor to the feedback circuit and the current inputting from the current mirror to the first MOSFET are proportional.

7. The low dropout voltage regulator of claim 6, wherein the current inputting from the power transistor to the feedback circuit is greater than the current inputting from the current mirror to the first MOSFET.

8. The low dropout voltage regulator of claim 1, wherein the current mirror is a cascade current mirror.

9. The low dropout voltage regulator of claim 1, wherein the current mirror is a wide-swing cascade current mirror.

10. The low dropout voltage regulator of claim 1, wherein the power transistor is a power metal oxide semiconductor field effect transistor.

11. The low dropout voltage regulator of claim 1, further comprising:

a compensation capacitor, having one terminal coupled to the output terminal of the operational amplifier, and another terminal being grounded; and a compensation network, coupled between the output voltage and the invert-phase input terminal of the operational amplifier, wherein the compensation capacitor results in a pole point of a loop gain in the low dropout voltage regulator, and the compensation network results in a zero point of the loop gain, the pole point and the zero point affect the unit-gain frequency of the loop gain, so that a phase margin of the loop gain is greater than zero.

12. The low dropout voltage regulator of claim 11, wherein the compensation network is a voltage-to-current converter.

* * * * *